US010084254B2

(12) United States Patent
Ge

(10) Patent No.: US 10,084,254 B2
(45) Date of Patent: Sep. 25, 2018

(54) HIGH POWER PLUG CONNECTOR

(71) Applicant: FOXCONN INTERCONNECT TECHNOLOGY LIMITED, Grand Cayman (KY)

(72) Inventor: Ming-Qi Ge, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/643,457

(22) Filed: Jul. 6, 2017

(65) Prior Publication Data

US 2018/0013218 A1 Jan. 11, 2018

(30) Foreign Application Priority Data

Jul. 6, 2016 (CN) ..... 2016 1 0525282

(51) Int. Cl.

| | |
|---|---|
| ***H01R 24/00*** | (2011.01) |
| ***H01R 12/72*** | (2011.01) |
| ***H01R 13/11*** | (2006.01) |
| ***H01R 13/24*** | (2006.01) |
| ***H01R 24/60*** | (2011.01) |

(52) U.S. Cl.

CPC ..... *H01R 12/727* (2013.01); *H01R 13/112* (2013.01); *H01R 13/2442* (2013.01); *H01R 24/60* (2013.01)

(58) Field of Classification Search

CPC ..... H01R 13/112; H01R 12/727
USPC ..... 439/636
See application file for complete search history.

(56) References Cited

U.S. PATENT DOCUMENTS

| | | | | |
|---|---|---|---|---|
| 9,525,227 | B2 * | 12/2016 | Little | H01R 13/6273 |
| 2015/0044886 | A1 * | 2/2015 | Little | H01R 12/75 439/55 |
| 2017/0229799 | A1 * | 8/2017 | Little | H01R 12/727 |

FOREIGN PATENT DOCUMENTS

| | | | |
|---|---|---|---|
| CN | 203813082 | U * | 9/2014 |
| CN | 204464641 | U | 7/2015 |
| CN | 204597047 | U | 8/2015 |
| CN | 105024197 | A | 11/2015 |
| CN | 105322327 | A | 2/2016 |
| CN | 105337108 | A | 2/2016 |

* cited by examiner

*Primary Examiner* — Abdullah Riyami
*Assistant Examiner* — Nader Alhawamdeh
(74) *Attorney, Agent, or Firm* — Wei Te Chung; Ming Chieh Chang

(57) ABSTRACT

An electrical connector includes an insulative housing an insulative housing enclosing two row of conductive terminals. Each of the terminals includes a front contacting section, a front spring section behind the front contacting section, a middle retaining section and a rear tail section along the front-to-back direction. In each row, the terminals include a pair of outer grounding terminals, a pair inner power terminals respectively beside the pair of outer grounding terminals, and a plurality of other terminals between the pair of power terminals in the transverse direction wherein for each of the pair of outer grounding terminals and the pair of inner power terminals, the front contacting section, the middle retaining section and the rear tails section are wider than the front contacting section in the transverse direction.

12 Claims, 14 Drawing Sheets

HIGH POWER PLUG CONNECTOR

BACKGROUND OF THE DISCLOSURE

1. Field of the Disclosure

The present disclosure relates to an electrical connector, and particularly to an electrical connector delivering high power.

2. Description of Related Arts

China Patent Nos. CN105337108 discloses the Type C receptacle connector with the contacts having the similar contacting sections, CN105024197 discloses the Type C receptacle connector with the contacts having enlarged contacting sections for the power contacts and the grounding contacts for delivering high power, CN105322327 discloses the Type C connector with contacts each having the similar width for the corresponding contacting section, tail section and the retaining section. Notably, all those three patents are related to the receptacle connector.

It is desired to make some improvement to the complementary plug cable connector which may be compatible with the receptacle connector delivering high power.

SUMMARY OF THE DISCLOSURE

Accordingly, an object of the present disclosure is to provide an electrical plug connector for delivering high power or charging quickly.

To achieve the above object, an electrical connector includes an insulative housing an insulative housing enclosing two row of conductive terminals. Each of the terminals includes a front contacting section, a front spring section behind the front contacting section, a middle retaining section and a rear tail section along the front-to-back direction. In each row, the terminals include a pair of outer grounding terminals, a pair inner power terminals respectively beside the pair of outer grounding terminals, and a plurality of other terminals between the pair of power terminals in the transverse direction wherein for each of the pair of outer grounding terminals and the pair of inner power terminals, the front contacting section, the middle retaining section and the rear tails section are wider than the front contacting section in the transverse direction. The distance between the outer grounding terminal and the corresponding inner power terminal is relatively larger than the distance between the adjacent two other terminals. The width of the grounding terminal and that of the power terminals are essentially larger than those of other terminals.

The housing forms a plurality of passageways to receive the corresponding terminals wherein a cross-sectional dimension of the passageway receiving the grounding terminal or the power terminals is larger than those receiving other terminals. The passageway forms a converging configuration extending through the corresponding exterior surface of the housing in the vertical direction to comply with the spring section of the corresponding grounding terminal or power terminal for allowing the spring section of the corresponding grounding terminal or power terminal to pass during deflection.

DETAILED DESCRIPTION OF THE PREFERRED EMBODIMENT

Figure 1:
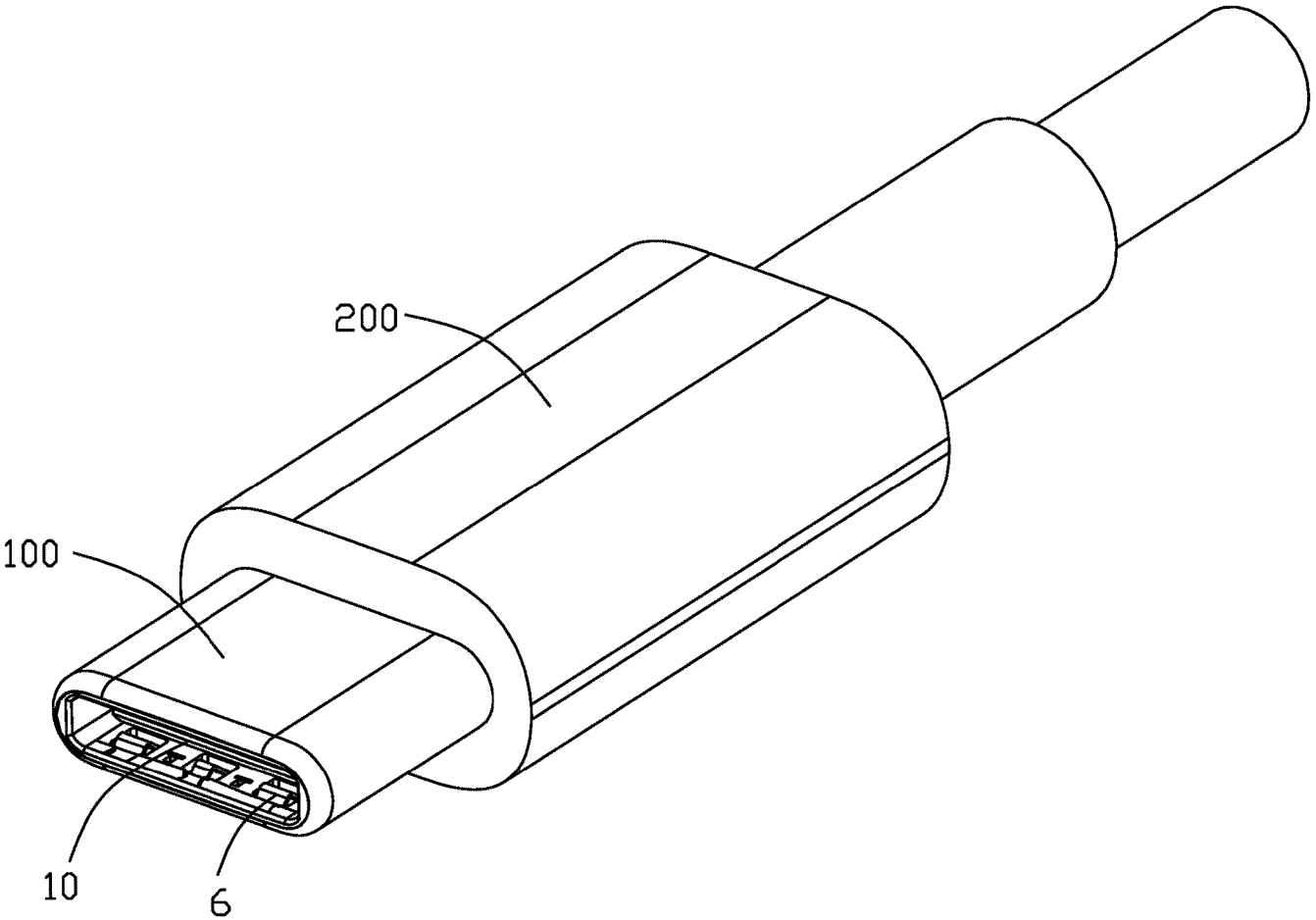
FIG. 1 is a perspective view of an electrical plug connector of the invention.
Figure 2:
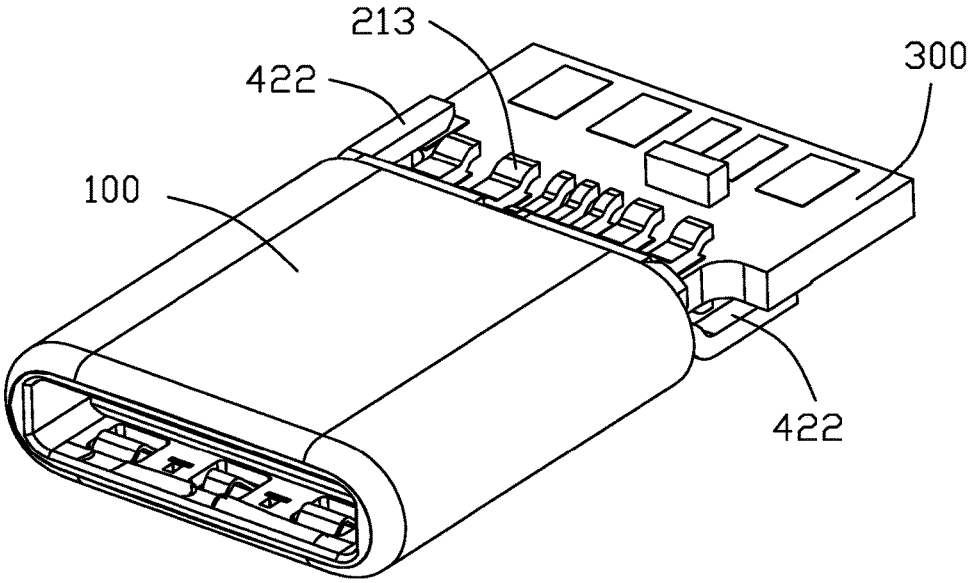
FIG. 2 is a perspective view of the mating part of the electrical connector of FIG. 1 connected with the corresponding internal printed circuit board.
Figure 3:
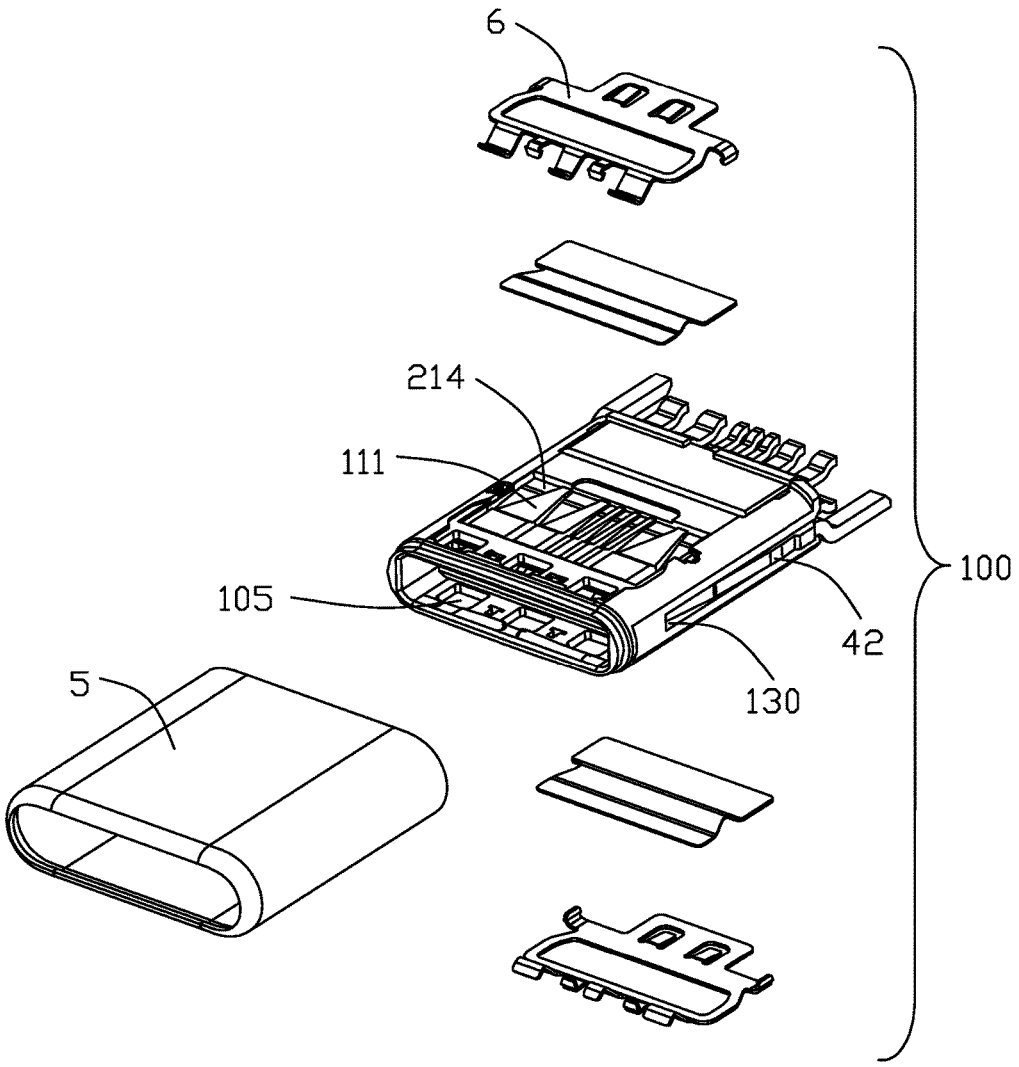
FIG. 3 is exploded perspective view of the mating part of the electrical connector of FIG. 2.
Figure 4:
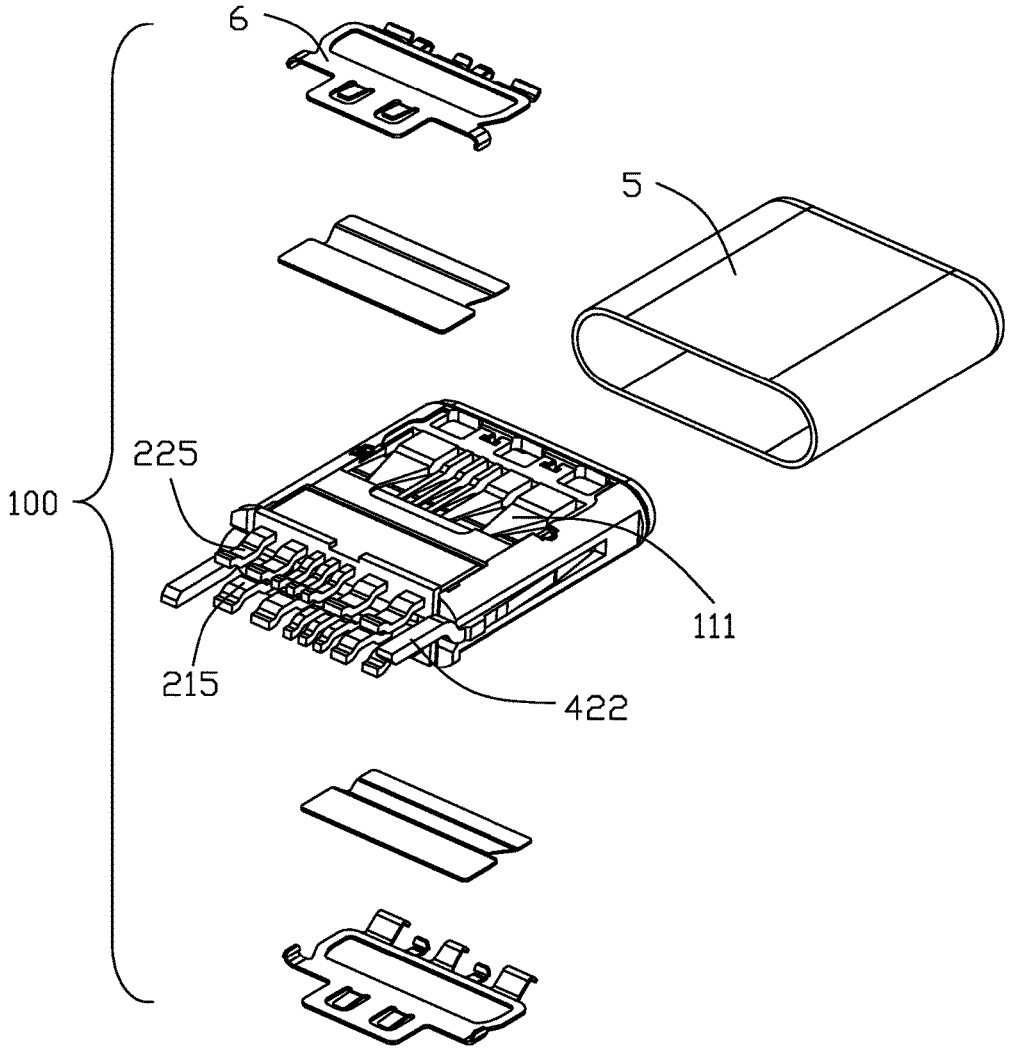
FIG. 4 is another exploded perspective view of the mating part of the electrical connector of FIG. 3.
Figure 5:
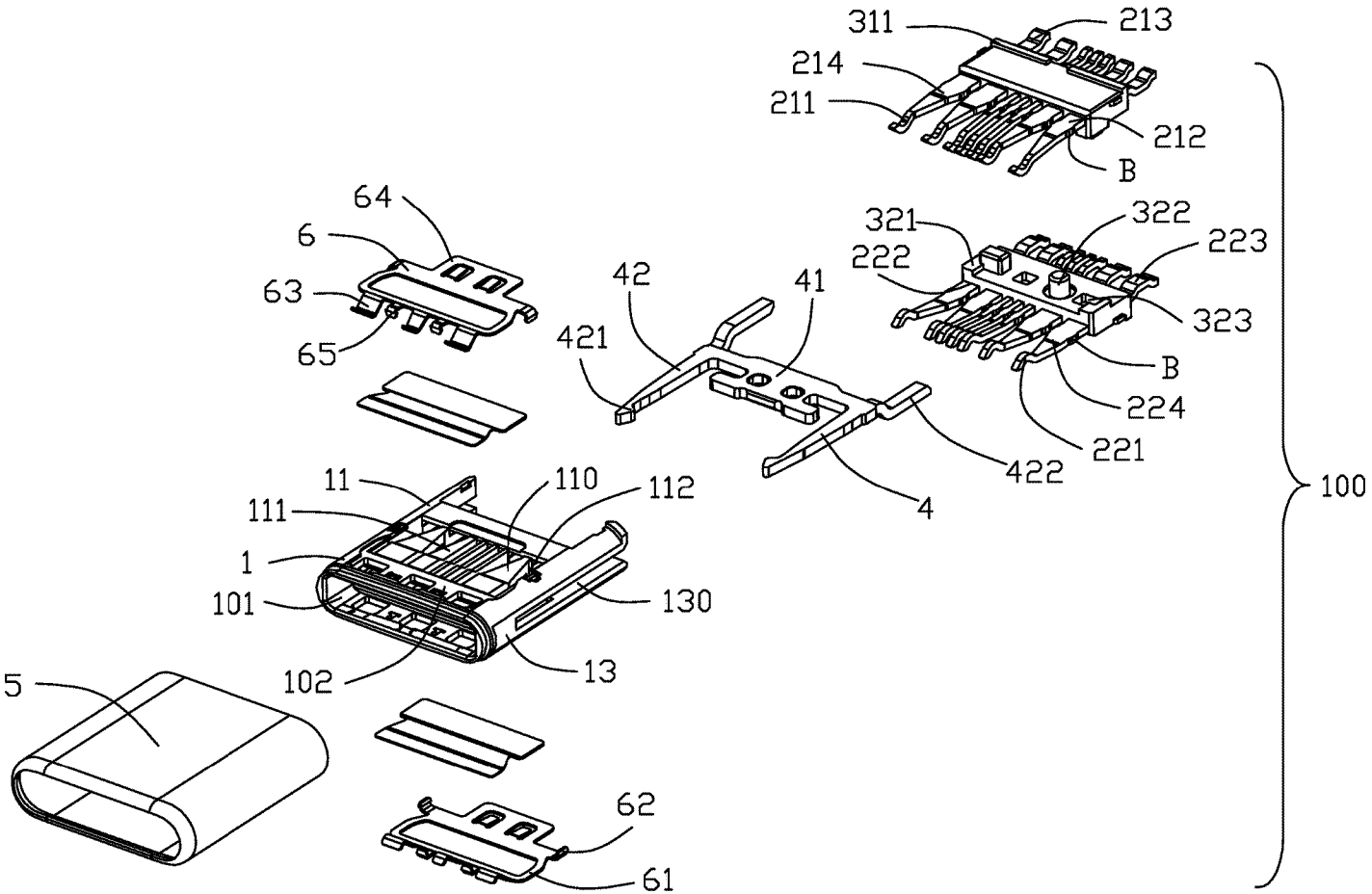
FIG. 5 is a further exploded perspective view of the mating parte of the electrical connector of FIG. 4.
Figure 6:
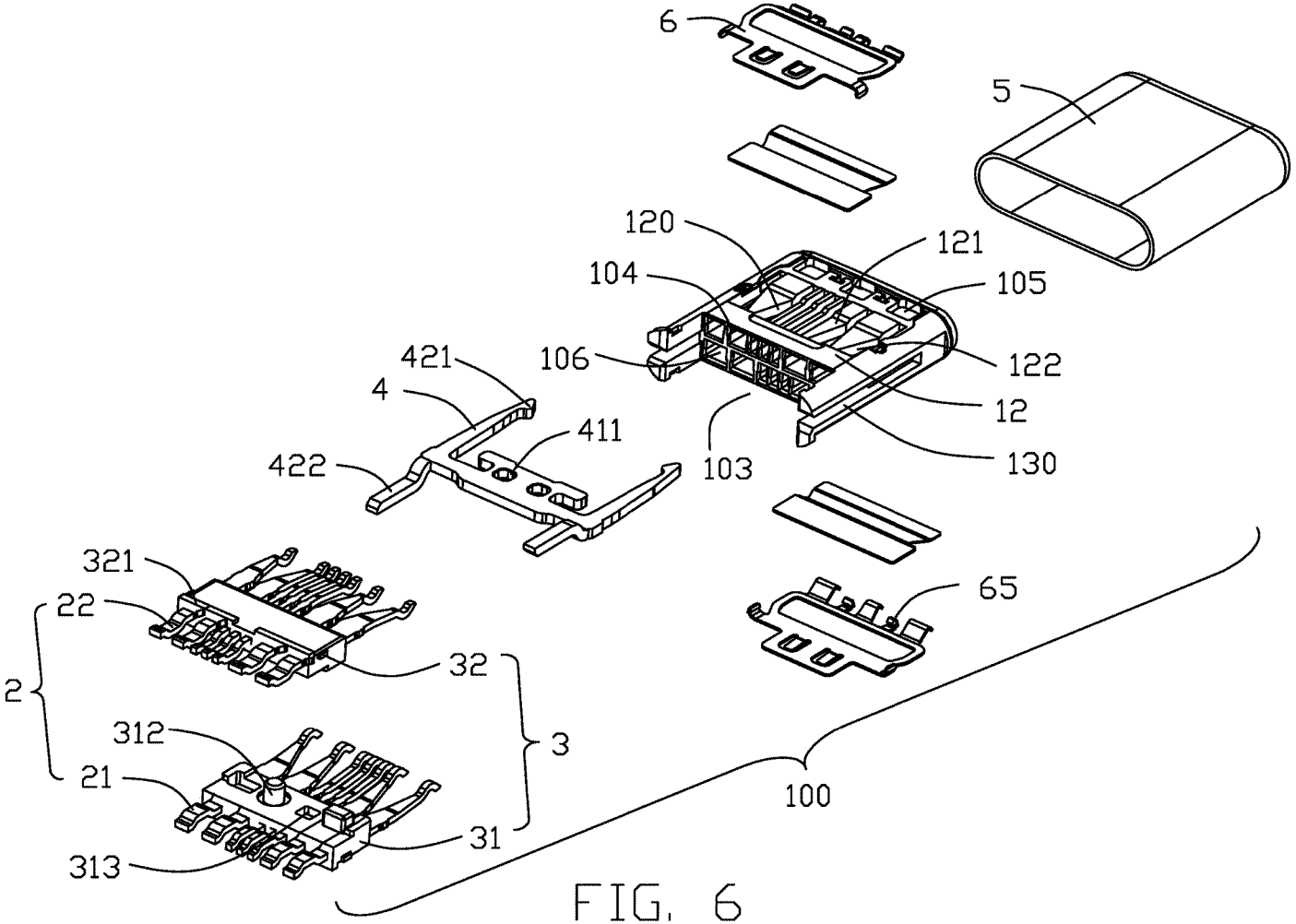
FIG. 6 is another perspective view of the mating part of the electrical connector of FIG. 5.

Reference will now be made in detail to the embodiments of the present disclosure. Referring to FIGS. 1-13, an electrical plug connector 100 integrally linked with a cable 200 with an internal printed circuit board 300 embedded therein. The plug connector 100 forms a receiving cavity 10 for mating with a receptacle connector (not shown) along a mating/front-to-back direction, a transverse direction perpendicular to the mating direction and cooperating with the mating direction to commonly form a horizontal plane, and a vertical direction perpendicular to both the mating direction and the transverse direction.

The electrical plug connector 100 includes an insulative housing 1, two rows of terminals 2 retained to the housing 1, and two insulators 3 each insert-molded with one corresponding row of terminals 2. A metallic latch 4 is located between two rows of terminals 2. A metallic shell 5 encloses the housing 1. A pair of spring plates 6 are attached upon the housing 1 to mechanically and electrically connect to the metallic shell 5.

The housing forms an elliptical cross-sectional structure and includes a top wall 11, a bottom wall 12 and a pair of side walls 13 linked therebetween so as to commonly form a receiving cavity 10. A front opening 101 is formed in the front portion 102 of the receiving cavity 10, and a rear opening 103 is formed in the rear portion 104 of the receiving cavity 10. A front end of the top wall 12 forms a first recess 110 to communicate with the front portion 102 of the receiving cavity 10; a front end of the bottom wall 12 forms a second recess 120 to communicate with the front portion 102 of the receiving cavity 10. The first recess 110 are divided into a plurality of first passageways 112 by the plurality of first dividers 111, and the second recess 120 are divided into a plurality of second passageways 122 by the plurality of second dividers 121. The terminals 2 are respectively received in the corresponding first passageways 112 and second passageways 122. The first dividers 111 and the second dividers 121 in the middle region have different widths with regard to those in the side regions. The first recess 110 and the second recess 120 extend along the mating direction. The side walls 13 forms the corresponding third recesses 130 extending along the mating direction while not through the front edge of the housing 1. The third recess 130 communicates with the front portion 102 and the rear portion 104 both. The top wall 11 and the bottom wall 12 form the through holes 105 corresponding to the spring plates 6. The first passageways 112 and the second passageways 122 form corresponding rear openings 106 in the rear face of the housing 1 with different cross-sectional dimensions.

The terminals 2 include the first terminals 21 received in the first recesses 110, and the second terminals 22 received in the second recesses 120. The first terminal includes a first contacting section 211 extending into the front portion 102, the first tail section 213 extending out of the rear opening 106, the first retaining section 212 linked with the first tail section 213, and the first spring section 214 linked between the first retaining section 212 and the first contacting section 211. The second terminal 22 includes a second contacting section 221 extending into the front portion 102, the second tail section 223 extending out of the rear opening 106, the second retaining section 222 linked with the second tail section 223, and the second spring section 224 linked between the second retaining section 222 and the second contacting section 221. The first tail section 213 and the second tail section 223 form first protrusion 215 and the second protrusion 225. The first protrusion 215 and the second protrusion 225 are exposed rearwardly outside of the housing 1 to form a space receiving the internal printed circuit board 300. The first contacting section 211 and the second contacting section 221 extend into the receiving cavity 10 for mating with the receptacle connector (not shown). The first spring section 214 and the second spring section 224 are exposed in the corresponding first passageway 112 and the second passageway 122 in a deflectable manner along the vertical direction. The first contacting sections 211 and the second contacting sections 221 are reversely symmetrically arranged with each other so as to allow the connector 100 to be mated within the corresponding receptacle connector in the flippable manner.

The first terminals 21 as well as the second terminals 22, include seven terminals, i.e., the grounding terminal, the power terminal, the positive signal terminal, a negative signal terminal, a spare terminal, a power terminal and the grounding terminal in sequence. For the grounding terminal and the power terminal of the first terminals 21, the first retaining section 212, the first tail section 213 and the first spring section 214 are wider than the first contacting section 211, and the second terminals 22 are as well. On the other hand, the first retaining section 212, the first tail section 213 and the first spring section 214 are wider than those of other first terminals 21. The width of the spring section 214 is gradually narrowed from the first retaining section 212 toward the first contacting section 211. The thicknesses of first contacting section 211 and the first spring section 214 thinner than those of the first retaining section 212 and the first tail section 213. The second terminals 22 have the same characters. Dimensionally, the contacting section of the outermost grounding terminal and that of the inner neighboring power terminal are space from each other with two contacting section positions in the transverse direction. This is also the reason why the spring section, the retaining section and the tails sections of those grounding terminal and power terminal could be widened in the transverse direction for high power delivery.

The insulator 3 including a first/upper insulator 31 retaining the first terminals 21 and a second/lower insulator 32 for retaining the second terminals 22. The upper insulator 31 includes a first abutting section 311, the first post 312 and the first groove 313. The lower insulator 32 includes a second abutting section 321, the second post 322 and the second groove 323. The first post 312 is received within the second groove 323, the second post 322 is received within the first groove 313 for securing the first insulator 31 and the second insulator 32 together. The first abutting section 311 and the second abutting section 321 abut against the rear portion 104 when the insulator 3 is assembled to the housing 1.

The latch 4 includes a support 41 and a pair of locking arms 42. The latch 4 is assembled to the housing 1 from the rear opening 103. The locking arms 42 are received within the third recesses 130. The support 41 forms a plurality of holes 411 through which the first post 312 extends into the second groove 323, and the second post 322 extends into the first groove 313 so as to have the upper insulator 31, the lower insulator 32 and the latch 4 therebetween secured together. The pair of locking arms 42 includes a front locking section 421 and the rear retaining section 422. The shell 5 encloses the top wall 11, the bottom wall 12 and the pair of side walls 13.

Figure 7:
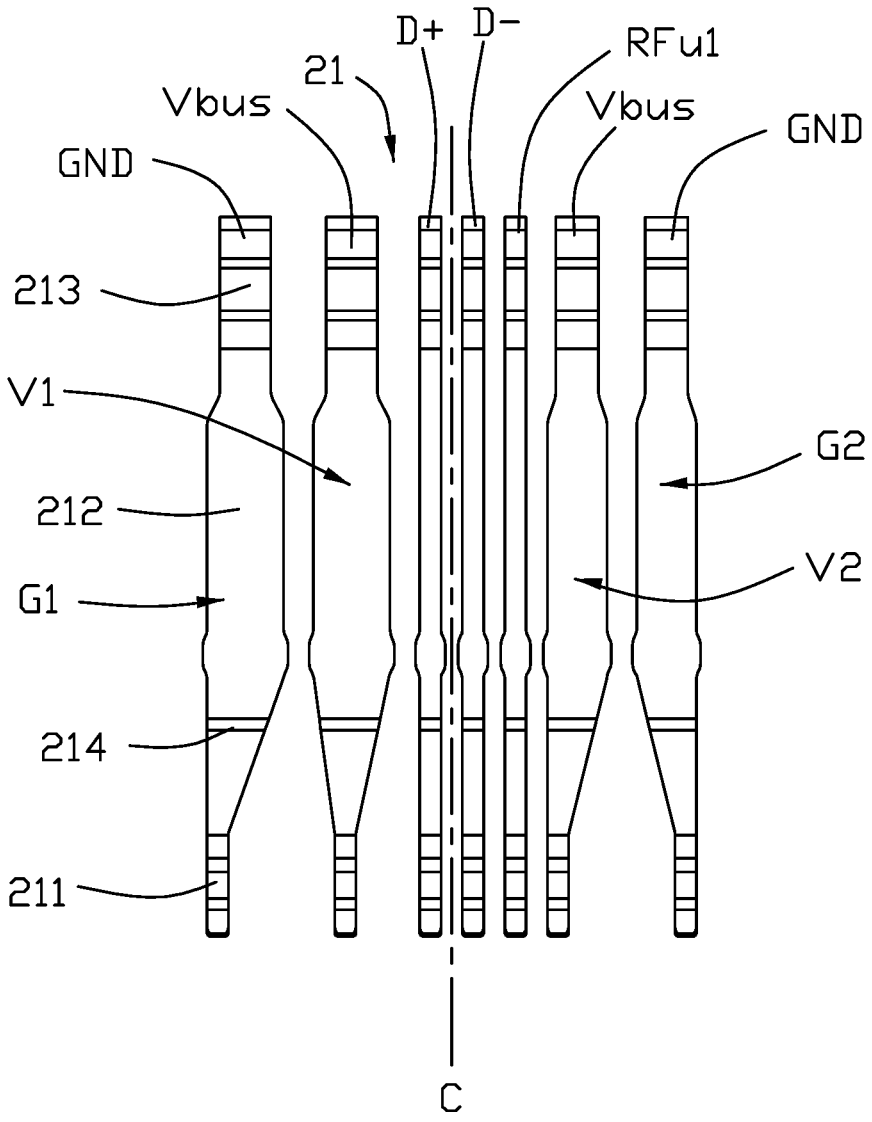
FIG. 7 is a plane view of one row of terminals of the electrical connector of FIG. 1.
Figure 8:
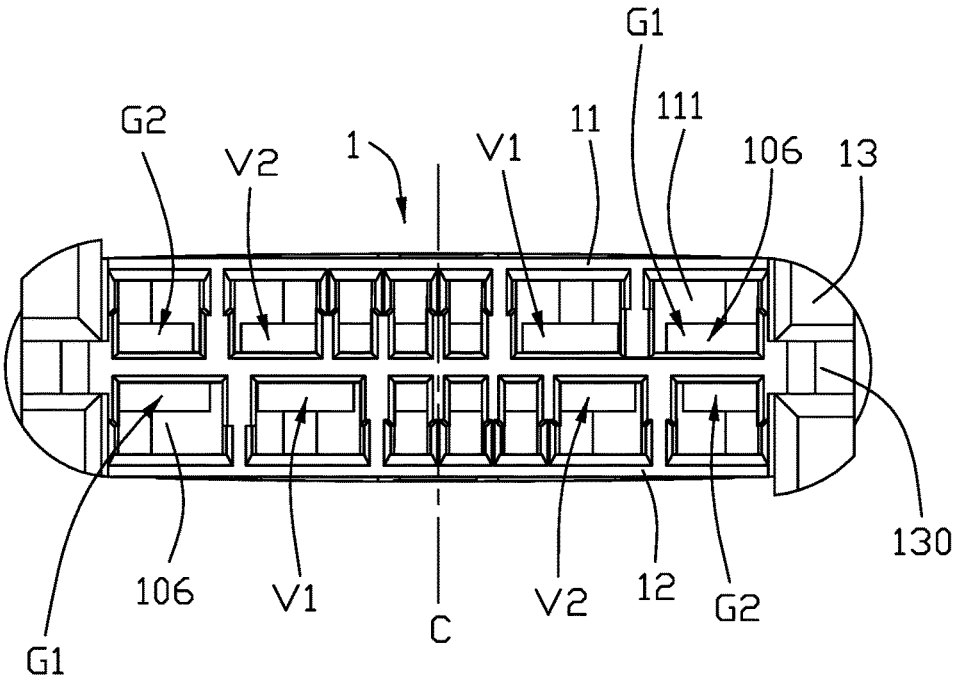
FIG. 8 is a rear elevational view of the housing of the mating part of the electrical connector of FIG. 6.
Figure 9A:
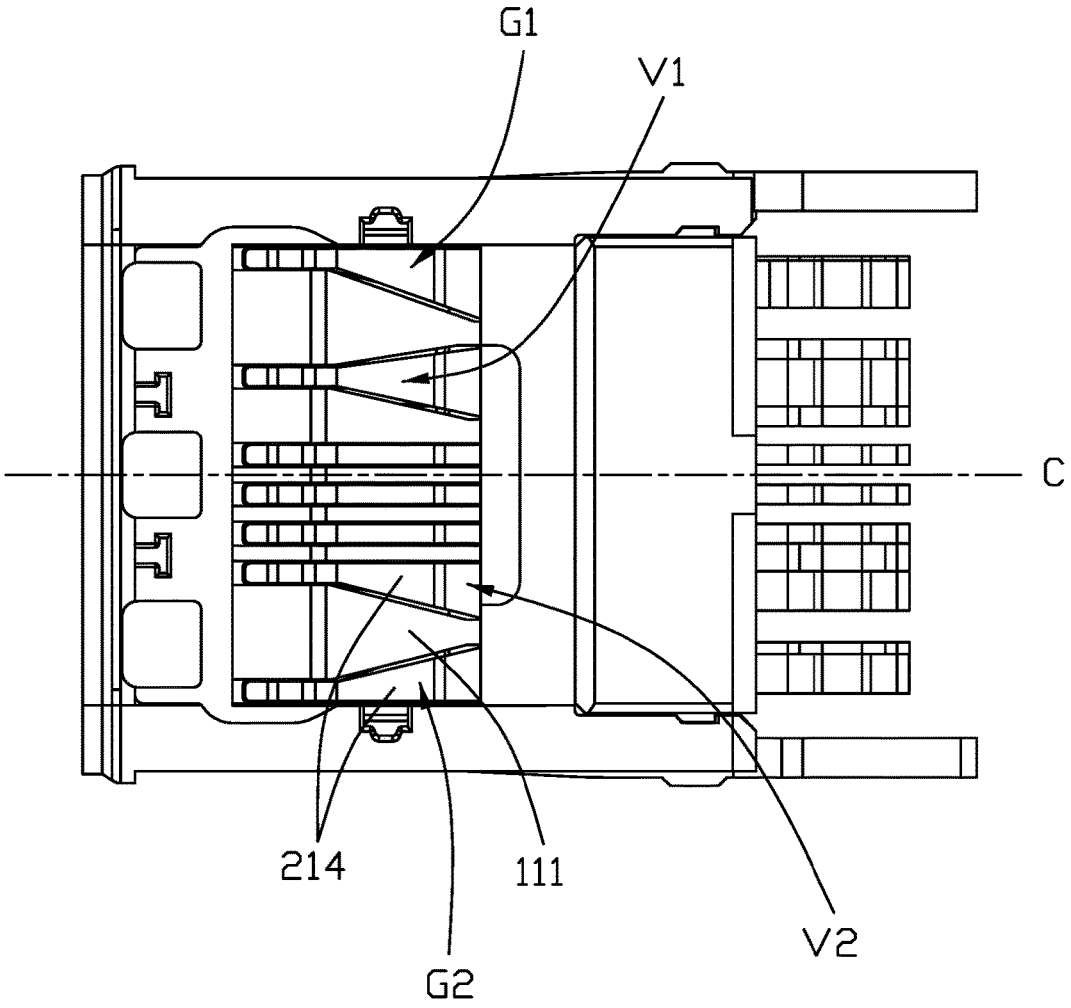
FIG. 9(A) is a top view of the mating part of the electrical connector of FIG. 1.
Figure 9B:
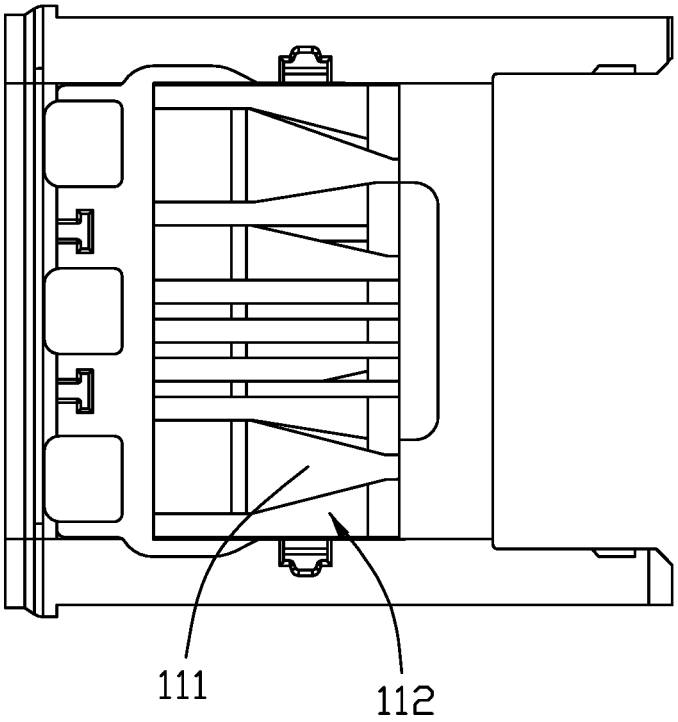
FIG. 9(B) is a top view of the mating part of the electrical connector of FIG. 1 without the terminals therein.
Figure 10:
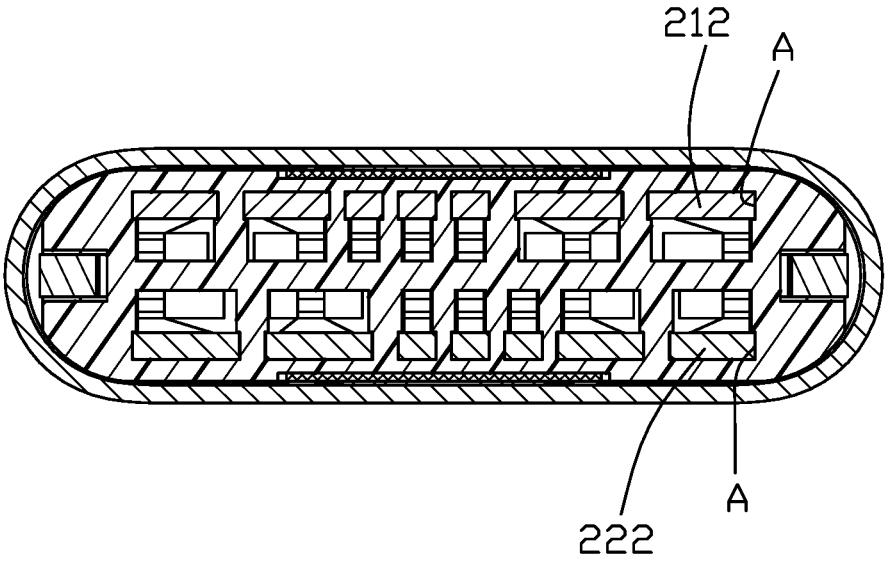
FIG. 10 is a cross-sectional view of the electrical connector of FIG. 1.
Figure 11:
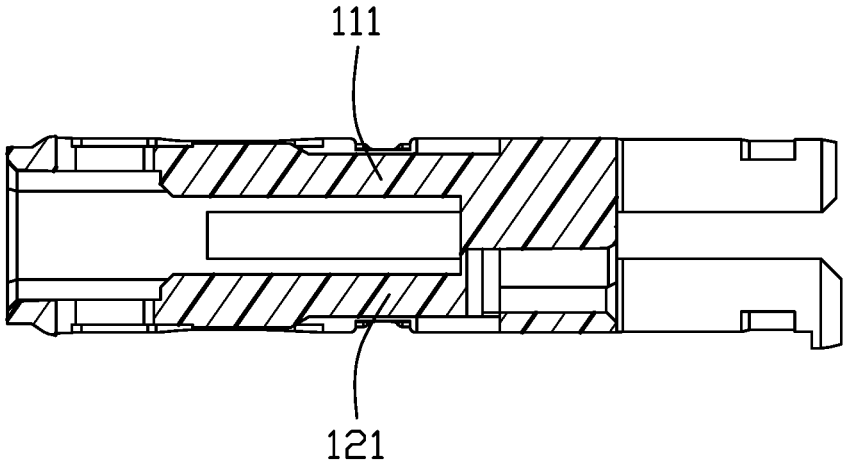
FIG. 11 is a cross-sectional view of the housing of the electrical connector of FIG. 1.
Figure 12:
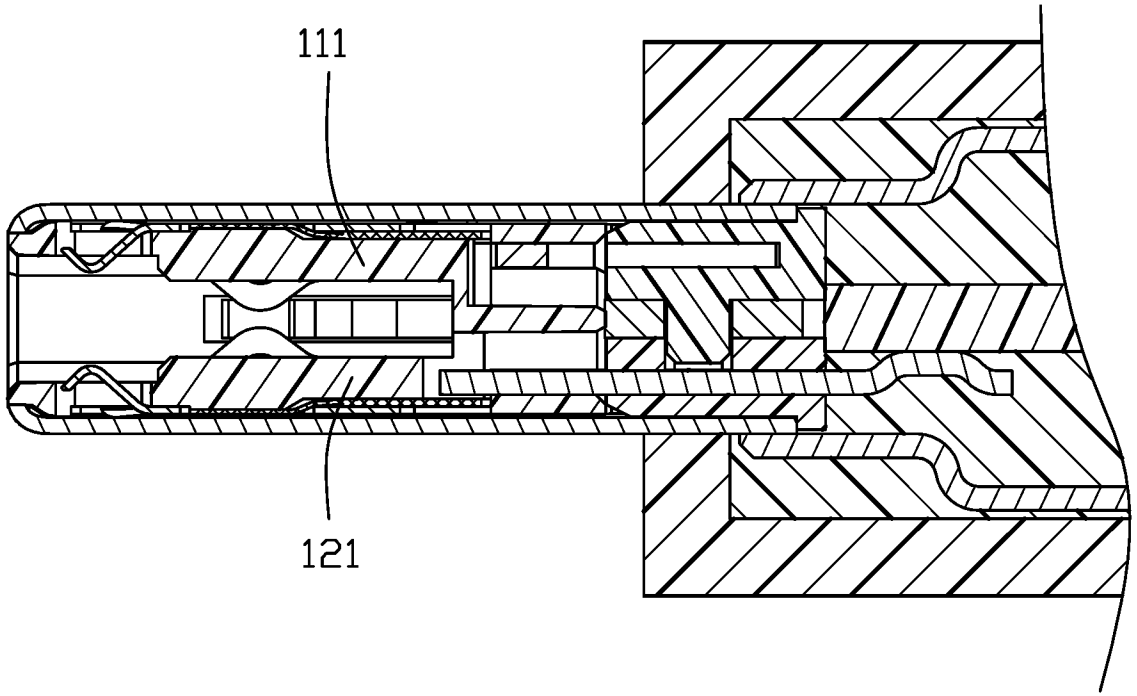
FIG. 12 is a cross-sectional view of the electrical connector of FIG. 1.
Figure 13:
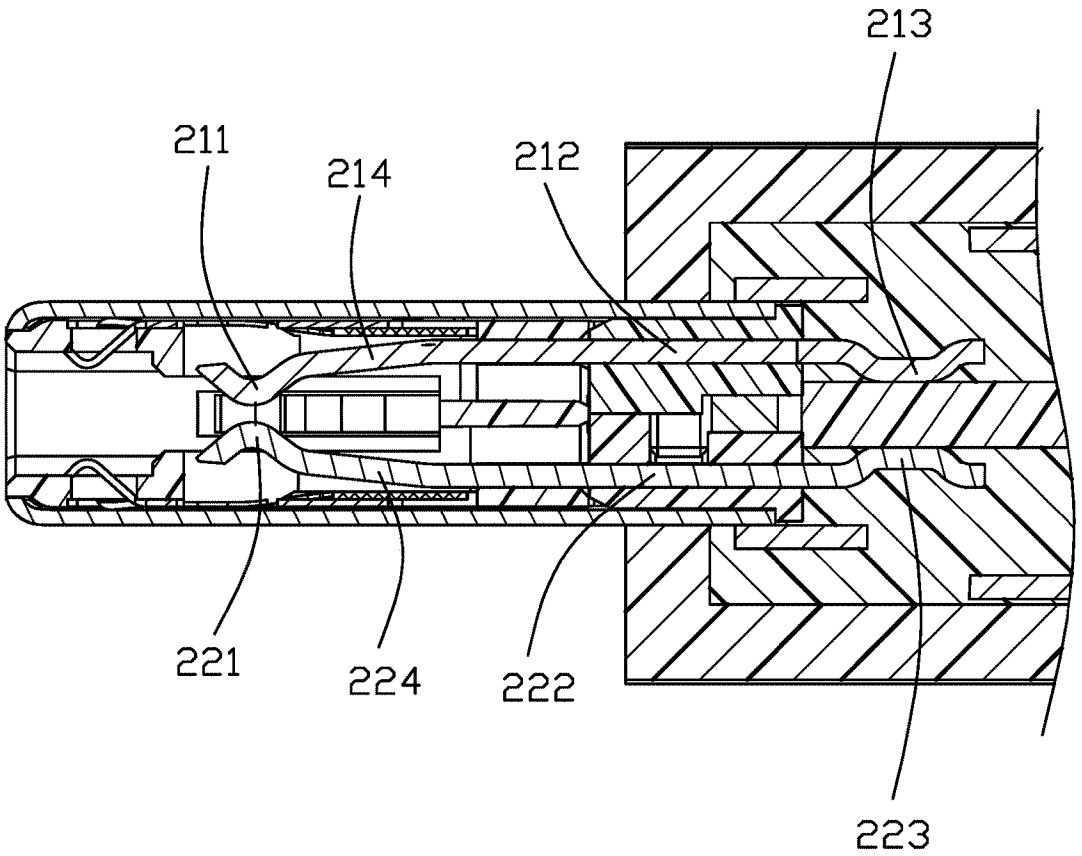
FIG. 13 is another cross-sectional view of the electrical connector of FIG. 1.

There are a pair of spring plates 6 respectively disposed upon the top wall 11 and the bottom wall 12. The spring plate 6 includes a frame 61, the mounting sections 62 and retaining arms 65 both for mounting to the housing 1, the spring arms 63 extending through the through holes 105 into the receiving cavity 10 for coupling to the receptacle connector, and the pressing section 64 electrically and mechanically connected to the shell 5. Notably, in this embodiment, the retaining section 214, 224 is equipped with barbs B received in the corresponding slots A in the corresponding passageway 112, 122 for efficiently regaining the terminals 21, 22 therein. One feature of the invention is to provide the different dimensionally sized passageways 112, 122 by the different dimensioned/shaped dividers 111, 121, compared with the traditional plug connector having the same dimensioned passageways divided by the same dimensioned/shaped dividers. Notably, in the top view the width of the divider varies so the corresponding passageways by two sides vary corresponding in a reverse proportional relation. In this embodiment, the divider forms a diverging configuration in a top view so as to form a converging configuration of the corresponding passageways by two sides thereof. Anyhow, the contacting sections keep the same width for assuring correct mating with the complementary receptacle connector. Another feature of the invention is to have the divider 111, 121 have the larger height in the vertical direction and the smaller thickness in the transverse direction around the rear opening 106 while having the smaller height in the vertical direction and the larger thickness in the transverse direction around the receiving cavity 10 for strength consideration and manufacturability of the whole housing 1. As shown in FIGS. 7, 8 and 9(A), yet another feature of the invention is to provide an asymmetrical arrangement with regard to the centerline C in each row of terminals 2 wherein three terminals 2 including a power terminal V1 and a grounding terminal G1 are located on one (first) side while the remaining four terminals 2 including another power terminal V2 and another grounding terminal G2 are located on the other (second) side of the centerline C. Notably, the corresponding power terminal V1 and grounding terminal G1 on the first side have larger widths than the corresponding power terminal V2 and grounding terminal G2 on the second side. The corresponding passageways 112 and 122 are also formed in compliance with the corresponding terminals 21 and 22 with the same width relation. Such an arrangement is to provide the maximum power delivery within the standard connector dimension. In conclusion, as shown in FIG. 8, the two rows of terminals 21, 22 are arranged, to each row, in an asymmetrical manner with regard to the corresponding centerline C which is a front-to-back centerline with regard to a transverse/width direction of the whole connector while the asymmetrically arranged terminals 21 in one row are reversely/diagonally symmetrical with the asymmetrically arranged terminals 22 in the other row in the vertical direction.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical plug connector comprising:

an insulative housing including opposite top wall and bottom wall commonly defining a receiving cavity therebetween around a front portion thereof in a vertical direction, said receiving cavity forwardly communicating with an exterior in a front-to-back direction perpendicular to said vertical direction;

a plurality of passageways formed in each of said top wall and said bottom wall and arranged with one another along a transverse direction perpendicular to both said vertical direction and said front-to-back direction, each of said passageways extending along the front-to-back direction;

a plurality of terminals disposed in the corresponding passageways, respectively, said terminals including power terminals, grounding terminals and signal terminals, each of said terminals including a front contacting section, a rear tail section, a middle retaining section in front of the rear tails section, and a spring section linked between the front contacting section and the middle retaining section; wherein for the power terminal and the grounding terminal, a width of the front contacting section is smaller than those of the corresponding spring section, retaining section and tail section; wherein each of said top wall and said bottom wall has a plurality of dividers each located between the adjacent two passageways with varied widths in the transverse direction when measured along the front-to-back direction, so as to form the varied cross-sections of the corresponding passageways for complying with the corresponding terminal having different widths in the front contacting section and the spring section.

2. The electrical plug connector as claimed in claim 1, wherein the divider forms a diverging configuration in the top view, measure along the front-to-back direction.

3. The electrical plug connector as claimed in claim 1, wherein the divider has a larger height in the vertical direction and smaller thickness in the transverse direction around a rear opening of the corresponding passageway while having a smaller height in the vertical direction and a larger thickness in the transverse direction around the receiving cavity.

4. An electrical plug connector comprising:

an insulative housing including opposite top wall and bottom wall commonly defining a receiving cavity therebetween around a front portion thereof in a vertical direction, said receiving cavity forwardly communicating with an exterior in a front-to-back direction perpendicular to said vertical direction;

a plurality of passageways formed in each of said top wall and said bottom wall and arranged with one another along a transverse direction perpendicular to both said vertical direction and said front-to-back direction, each of said passageways extending along the front-to-back direction;

a plurality of terminals disposed in the corresponding passageways, respectively, said terminals including power terminals, grounding terminals and signal terminals, each of said terminals including a front contacting section, a rear tail section, a middle retaining section in front of the rear tails section, and a spring section linked between the front contacting section and the middle retaining section, the front contacting section of the grounding terminal and that of the neighboring power terminal being spaced from each other with a first distance larger than that between those of the two neighboring signals; wherein each of said top wall and said bottom wall has a plurality of dividers each located between the adjacent two passageways, and the divider between the passageways receiving the corresponding neighboring power and grounding terminals defines a larger width than that between the two passageways receiving the corresponding two signal terminals in the transverse direction.

5. The electrical plug connector as claimed in claim 4, wherein widths of the spring section and the retaining section of the power terminal and those of the grounding terminal, are larger than those of the signal terminal.

6. The electrical plug connector as claimed in claim 5, wherein the width of the divider beside the corresponding power terminal and grounding terminal varies in the transverse direction for comply with width change between the spring section and the contacting section of said power terminal and said grounding terminal.

7. An electrical plug connector comprising:

an insulative housing including opposite top wall and bottom wall commonly defining a receiving cavity therebetween around a front portion thereof in a vertical direction, said receiving cavity forwardly communicating with an exterior in a front-to-back direction perpendicular to said vertical direction;

a plurality of passageways respectively formed in each of said top wall and said bottom wall and arranged with one another along a transverse direction perpendicular to both said vertical direction and said front-to-back direction, each of said passageways extending along the front-to-back direction; and a plurality of first terminals respectively disposed in the corresponding passageways in the top wall, and a plurality of second terminals respectively disposed in the corresponding passageways in the bottom wall; wherein the housing defines a front-to-back centerline with regard to a width of the housing measured in the transverse direction; wherein the first terminals are asymmetrically arranged with regard to said centerline, and the second terminals are asymmetrically arranged with regard to said centerline too while the first terminals and the second terminals are reversely symmetrical with each other in the vertical direction.

8. The electrical plug connector as claimed in claim 7, wherein the first terminals have different amounts on opposite sides of the centerline.

9. The electrical plug connector as claimed in claim 8, wherein the first terminals have a power terminal and a grounding terminal on one side of the centerline, and another power terminal and another grounding terminal on the other side, said power terminal and said grounding terminal having widths larger than those of said another power terminal and said grounding terminal.

10. The electrical plug connector as claimed in claim 9, wherein the first terminals have three corresponding terminals on one side and four corresponding terminals on the other side of the centerline.

11. The electrical plug connector as claimed in claim 10, wherein the passageways in the top wall have three corresponding passageways on one side and four corresponding passageways on the other side of the centerline to receive the corresponding first terminals, respectively.

12. The electrical plug connector as claimed in claim 11, wherein the passageways receiving said power terminal and said grounding terminal are wider than those receiving said another power terminal and said another grounding terminal.

* * * * *